United States Patent [19]

Klein et al.

[11] Patent Number: 4,666,589

[45] Date of Patent: May 19, 1987

[54] METHOD FOR PRETREATING FEEDSTOCKS FOR COAL HYDROGENATION

[75] Inventors: Wolf-Dieter Klein; Alfons Feuchthofen, both of Recklinghausen; Claus Strecker, Gelsenkirchen; Ulrich Bönisch, Mülheim, all of Fed. Rep. of Germany

[73] Assignee: Veba Oel Entwicklungs-Gesellschaft mbH, Gelsenkirchen, Fed. Rep. of Germany

[21] Appl. No.: 829,904

[22] Filed: Feb. 18, 1986

[30] Foreign Application Priority Data

Feb. 18, 1985 [DE] Fed. Rep. of Germany ..... 3505553

[51] Int. Cl.[4] ..... C10G 1/06

[52] U.S. Cl. ..... 208/413; 208/418

[58] Field of Search ..... 208/413, 418, 416, 412

[56] References Cited

U.S. PATENT DOCUMENTS

| | | | |
|---|---|---|---|
| 4,214,974 | 7/1980 | Würfel | 208/418 |
| 4,487,684 | 12/1984 | Würfel | 208/413 |
| 4,492,623 | 1/1985 | Würfel | 208/413 X |

FOREIGN PATENT DOCUMENTS

| | | | |
|---|---|---|---|
| 534402 | 12/1958 | Canada | 208/418 |
| 3246609 | of 0000 | Fed. Rep. of Germany . | |
| 2651233 | 5/1978 | Fed. Rep. of Germany | 208/418 |

*Primary Examiner*—Glenn Caldarola

*Attorney, Agent, or Firm*—Oblon, Fisher, Spivak, McClelland, & Maier

[57] ABSTRACT

A method for pretreating a coal hydrogenation feedstock with preheated hydrogen containing a hydrogenation gas under high pressure and at elevated temperature, in a liquid phase slurry system, is disclosed. In this process a mixture of a slurry of finely ground coal and a slurry oil are fed to a preheater before being subjected to a hydrogenation and liquefaction reaction in a cascade of reactors at a pressure of from 100 to 40 bars and a temperature of 420° to 490° C. The reaction products are fed to a hot separator.

In the process of the invention, prior to its preheating, a first partial stream of the hydrogenation gas, referred to as the slurry gas, is added to the mixture at process pressure. A second partial stream of the hydrogenation gas is heated by indirect heat exchange with a gaseous hot separator product in a gas heat exchanger. The mixture of slurry and slurry gas is preheated through indirect heat exchange in at least one heat exchanger downstream from the first gas heat exchanger, through which flows the hot separator head product after passing through the first heat exchanger. The heated second partial stream of hydrogenation gas is then added to the preheated mixture of slurry and slurry gas.

This process provides improved heat transfer during the preheating of the coal-oil slurry and the mixture in a slurry with a hydrogenation gas.

10 Claims, 3 Drawing Figures

METHOD FOR PRETREATING FEEDSTOCKS FOR COAL HYDROGENATION

BACKGROUND OF THE INVENTION

1. Field of the Invention

The invention relates to a method for pretreating feedstocks for coal hydrogenation with a preheated hydrogen containing hydrogenation gas.

2. Discussion of the Background

It is known in coal hydrogenation processes that the total required quantity of hydrogenation gas is heated with the coal-oil slurry. It is also known that a part of the hydrogenation gas is preheated separately and added to the coal-oil slurry before the preheater and another part of the hydrogenation gas is preheated separately and added downstream from the preheater to the coal-oil slurry, prior to entering the hydrogenation reactor (cf. EP-OS No. 0 083 830).

The hydrogen-containing hydrogenation gas is made up of two parts; a first part is the circulating gas remaining after separation of the coal liquefaction products and a second part is fresh hydrogen added to make up for hydrogen consumption (cf. "Die katalytische Druckhydrierung von Kohlen, Teeren und Mineraloelen" (The catalytic hydrogenation under pressure of coals, tars and mineral oils), Springer-Verlag Berlin/-Gottingen/Heidelberg 1950, p. 36).

It is also known that the coal-oil slurry of finely ground coal and the slurry oil, which is a recycle distillate stream from the operation of a coal liquefaction process, undergoes a swelling stage during heating. Depending on the type of coal, the type of slurry oil and the pretreatment, the swelling of these mixtures takes place within a temperature range of about 280° to 390° C. Appropriate means in which the swelling of the slurry takes place can be provided for upstream from the preheater, said means being an expanded pipe or a bottle-shaped receptacle (cf. DRP No. 715 988). The heat transfer in the vertical heat exchanger pipes of the preheater, on the outside of which flows the heating gas longitudinally and on the inside of which flows the slurry, is a critical step in all coal liquefaction processes.

When heating the three-phase mixture of the coaloil slurry in the presence of the hydrogen-containing hydrogenation gas there is a risk of sedimentation of the solid components in the heat exchanger pipers of the preheater. In addition, the suspension can evaporate to dryness through the evaporation of the low-boiling components of the slurry oil.

As a result of the swelling process, a great increase in viscosity occurs in the section between the initial heat exchanger(s) for the slurry and the hydrogenation gas mixture and the preheater. The increase in viscosity can cause a considerable pressure drop in the absence of special precautions. This loss of pressure would have to be compensated by conveying means as pumps and the like.

SUMMARY OF THE INVENTION

Accordingly, one object of this invention is to improve the heat transfer during the preheating of the coal-oil slurry and the mixtures of the slurry with the hydrogenation gas.

It is another object of this invention to provide a method for improving the heat transfer during heating of the slurry and of the mixtures of the slurry with the hydrogenation gas.

It is another object of this invention to provide a method to keep the coal-oil slurry from sedimentation and drying out, particularly in the preheater section.

It is another object of this invention to provide a method which reduces the energy consumption for the operation of the conveying means, in particular slurry pumps and gas compressors.

Therefore a method is provided for pretreating feed stock for coal hydrogenation which satisfies all of the above objects, and other objects which will become apparent from the description of the invention given hereinbelow. The method of the invention is a method for pretreating feedstocks for coal hydrogenation with preheated hydrogen containing a hydrogenation gas under high pressure and at an elevated temperature, in a liquid phase system. If needed, a catalyst may be added. In this process a slurry of finely ground coal and a slurry oil, preferably originating from the coal liquefaction process, is fed to a preheater. It is subsequently subjected to a hydrogenation and liquefaction reaction in a cascade of reactors at a pressure of from 100 to 400 bars and at a temperature of from 420° to 490° C., where the reaction products are fed to a hot separator which is a vapor/liquid separation system for the reaction products.

In this process the total hydrogenation gas requirement for the coal liquefaction reaction is split into two streams. A first partial stream of the hydrogenation gas, designated as slurry gas and prior to its preheating, is mixed with slurry brought to the process pressure. The second partial stream of the hydrogenation gas is heated by heat exchange with the gaseous hot separator head product in a first heat exchanger having a gas heat exchanger configuration. The mixture of slurry and slurry gas is preheated by heat exchange in one or several heat exchangers located downstream from the gas heat exchanger, through which the hot separator head product passes after passing the first gas heat exchanger. The said second partial stream of the hydrogenation gas thus heated is then added to the preheated mix of slurry and slurry gas.

BRIEF DESCRIPTION OF THE DRAWINGS

A more complete appreciation of the invention and many of the attendant advantages thereof will be readily obtained by reference to following detailed description when considered in connection with the accompanying drawings, wherein.

DETAILED DESCRIPTION OF THE PREFERRED EMBODIMENTS

Figure 1:
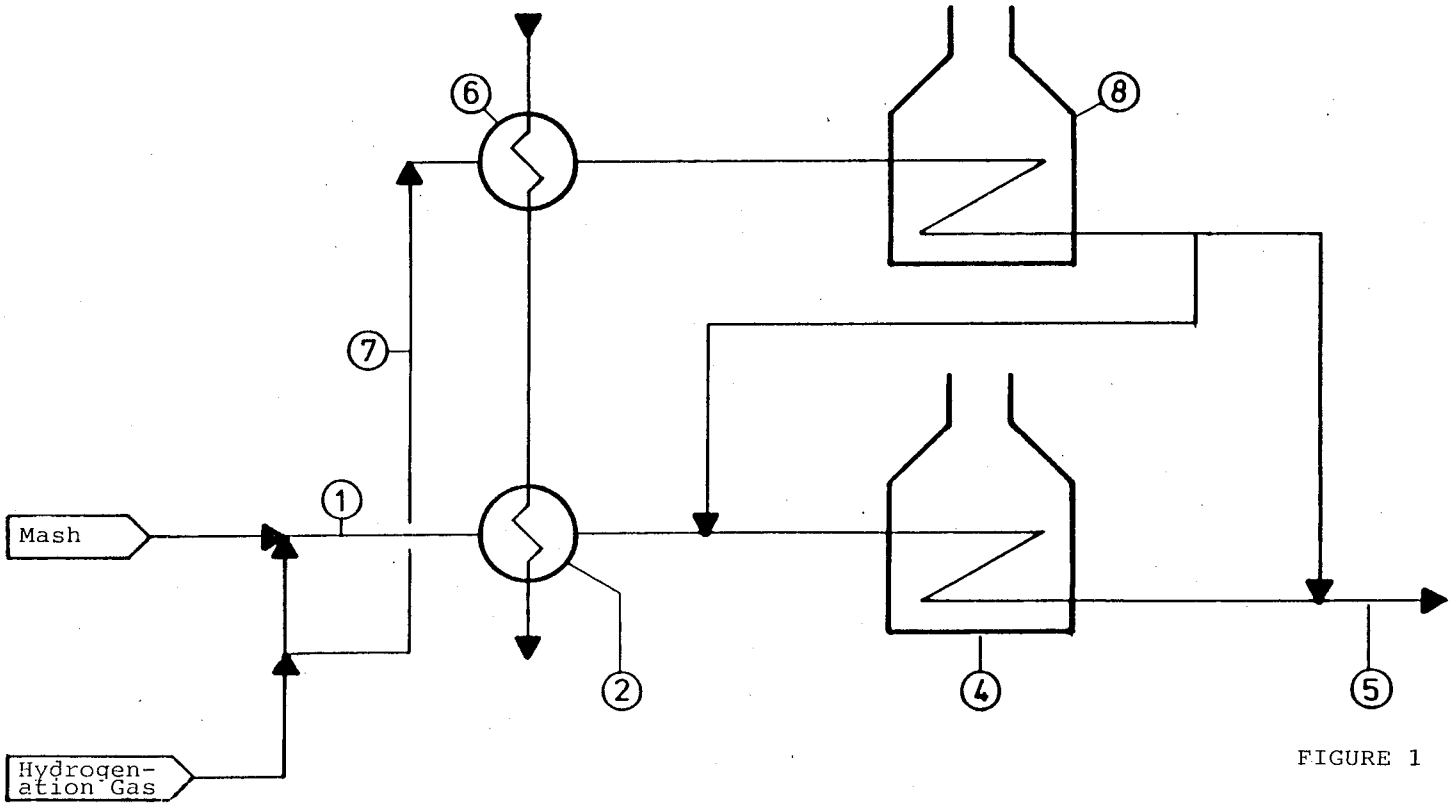
FIGS. 1, 2 and 3 are schematic representations of coal hydrogenation systems in which the method of this invention may be practiced.

In the present process, the said second partial stream of the hydrogenation gas which is heated by heat exchange with the gaseous hot separator head product and added to the preheated mixture of slurry and slurry gas preferably constitutes 50 to 80% by volume of the total quantity of hydrogenation gas required.

An advantageous embodiment provides that the said second partial stream of the hydrogenation gas which has been heated in the first gas heat exchanger is added to the mixture of slurry and slurry gas only after the mixture has passed through the preheater section.

Another embodiment provides that the said second partial stream of the hydrogenation gas which is passed through the said first gas heat exchanger and further heated in a furnace is added to the slurry downstream of the preheater. Yet a further partial stream can be split from this hydrogenation gas heated in the furnace and be added to the slurry prior to entering the preheater. The heating of the said second partial stream of the hydrogenation gas is in another embodiment effected separately in the furnace.

As discussed above, in the present process the total required quantity of hydrogenation gas is split into two partial streams. The first partial stream is added to the slurry that has been brought up to process pressure but not yet heated in a heat exchanger. The second partial stream is first heated by heat exchange with the gaseous hot separator head product in the said first gas heat exchanger and/or separately in the said furnace. By feeding the second partial stream of the hydrogenation gas to the mixture of slurry and slurry gas which is preheated in one or several heat exchangers, the desired advantageous bubble flow characteristics are obtained in all the heat exchangers except the gas heat exchanger. This provides improved heat transfer and suppression of sedimentation in the slurry suspension.

It is also possible to split the flow of the hydrogen-containing hydrogenation gas in such a manner that fresh hydrogen is added as the slurry gas to the slurry. The remaining quantity of the total quantity of fresh hydrogen to be added is admixed to the recycled portions of hydrogenation gas.

A higher partial hydrogen pressure in the slurry gas is thereby achieved and the compressor for circulating the hydrogenation gas can be designed with a correspondingly smaller capacity. Smaller heat exchange tubes ("hairpin tubes") can also be provided in the preheater for the slurry-hydrogenation gas mixture.

Swelling is severely accelerated by admixing the hydrogenation gas that has been preheated to such high temperatures as 350° to 550° C. to the slurry and by providing a swelling section limited to a defined space. For this, the swelling section can be designed as a section in which the effective cross-section is enlarged.

The head product of the hot separator initially passed through the gas heat exchanger for heating the said second partial stream of the hydrogenation gas is fed subsequently to the slurry preheaters, where, in counterflow to the slurry, the hot separator head product is further cooled by heat exchange. Here, the slurry containing only a part, preferably 20 to 50% by volume, of the quantity of hydrogenation gas (slurry gas) is preheated in the heat exchangers.

The evaporation in the slurry preheaters is thereby reduced by 30 to 60%, whereby evaporation to dryness in only locally limited zones is avoided. Because of the higher content of unevaporated liquid product, a better dissolution of the coal is also achieved. In the reaction part of the system, i.e., in the actual hydrogenation reactors, the entire required quantity of hydrogenation gas is available after the remaining quantity of 50 to 80% by volume of the second partial stream of hydrogenation gas is added. Here the hydrogenation gas also assumes the function to effectively transfer to the hot separator the resulting vaporizable reaction products.

In the subject process, a part of the capacity of the preheater is substituted by the gas heat exchanger to which the head product of the hot separator has been contacted, or by the furnace. In this connection it is of great importance that the gas heat exchanger or the furnace for heating the said partial stream of the hydrogenation gas require only about one tenth of the total exchange area of a heat exchanger or preheater, respectively, for preheating the slurry which constitutes a multiphased system.

The separate preheating of one part of the hydrogenation gas permits a better heat utilization of the heat capacity of the head product of the hot separator, and makes possible a simplified preheater design. The layout and the operation of the preheater for heating the slurry are critical for the operation of a coal liquefaction facility.

The partial stream of the hydrogenation gas is heated in the gas heat exchanger to 350° to 480° C., maximum 500° C., in counterflow with the head product of the hot separator, or in the additional furnace to temperatures of between 350° and 550° C. and depending on operational requirements and on operating conditions of the preheater can be split into a partial stream admixed to the slurry at an upstream location from the preheater and a partial stream is admixxed to the slurry downstream from the preheater.

For further recovery from the head product of the hot separator, the slurry made of finely ground coal and a slurry oil is brought into pressure, mixed with the slurry gas and is contacted with the head product of the hot separator by indirect heat exchange in consecutively and in a downstream position from the said gas heat exchanger arranged heat exchangers, in counterflow. All types of coals which can be economically hydrogenated can be used, e.g., typical gasflame coal of the Ruhr area can be used. The slurry mixed with the slurry gas and, if appropriate, with the remaining hydrogenation gas, reaches a temperature of about 400° C. after passing through the heat exchangers, and a temperature of about 470° C. after passing through the downstream preheater. The head product of the hot separator which has cooled down after passing through the heat exchangers, is passed on in the usual manner for further reprocessing.

DESCRIPTION OF THE DRAWINGS

Reference is now made to the drawings, wherein like reference numerals designate identical or corresponding parts throughout the several views. After being mixed with the eventually preheated quantity of hydrogenation gas designated as slurry gas and the slurry is passed via conduit 1 through one or more consecutively arranged heat exchangers 2 as well as through preheater 4. If appropriate it is subsequently passed through an expansion section 3. The slurry enters the first hydrogenation reaction via conduit 5. The gaseous head product of the hot separator passes through a gas heat exchanger 6, in which the second partial stream of hydrogenation gas carried via conduit 7 is heated to a temperature of from 350° to 480° C., maximum of 500° C. The head product of the hot separator, then at a lower temperature, is passed through the slurry preheaters 2 and, if appropriate, a slurry gas preheater not illustrated in the drawings. The part of the hydrogenation gas carried in conduit 7 can be heated further by furnace 8 in a variant of this method.

If necessary, a part of the slurry gas needed as quench gas is separated. This part of the slurry gas is carried by an appropriate conduit to the reactor and the preheater.

A light and middle coal oil is obtained from the cooled head product of the hot separator, via fractionated condensation and, if appropriate, expansion and distillation in a known manner. This is used for further processing steps as hydrogenating and reforming in a vapor-phase hydrogenation which is consecutive to the liquid phase hydrogenation. Alternatively the light and middle coal oil constituents are directly, without pressure decrease and atmospheric distillation, subjected to refining into liquid heating oils and transportation fuels. The heavy oil components separated from the head product of the hot separator are generally recycled as part of the slurry oil.

More specifically, according to FIG. 1, slurry under process pressure is combined with the slurry gas by way of conduit 1. To heat further the remaining partial stream of hydrogenating gas carried in conduit 7 and heated in gas heat exchanger 6, a furnace 8 is provided. The thus heated hydrogenation gas flow is split and added to the mixture of slurry and slurry gas in one part before entering the preheater 4 and in the other part downstream from preheater 4. The heated reaction mixture is carried by conduit 5 to the first hydrogenation reactor.

Figure 2:
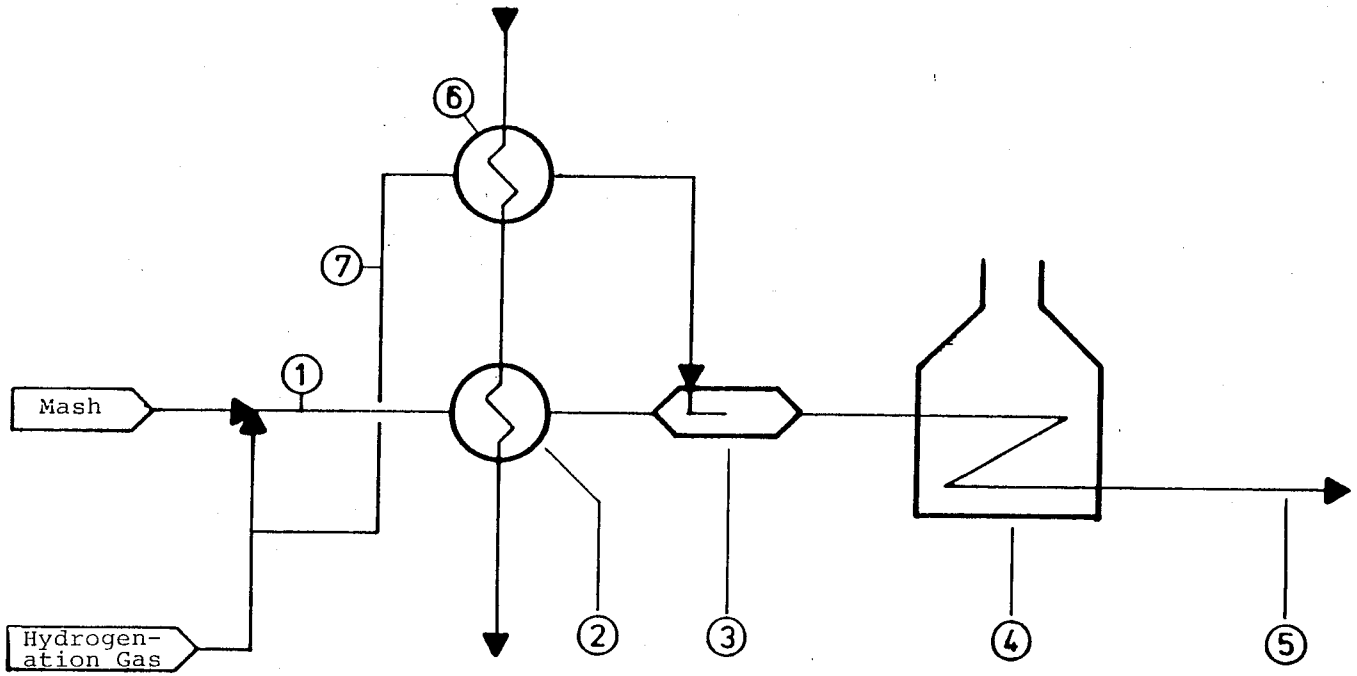

FIG. 2 shows an embodiment of the method in which the flow of hydrogenation gas carried via conduit 7 and gas heat exchanger 6 is fed to the slurry in swelling section 3.

Figure 3:
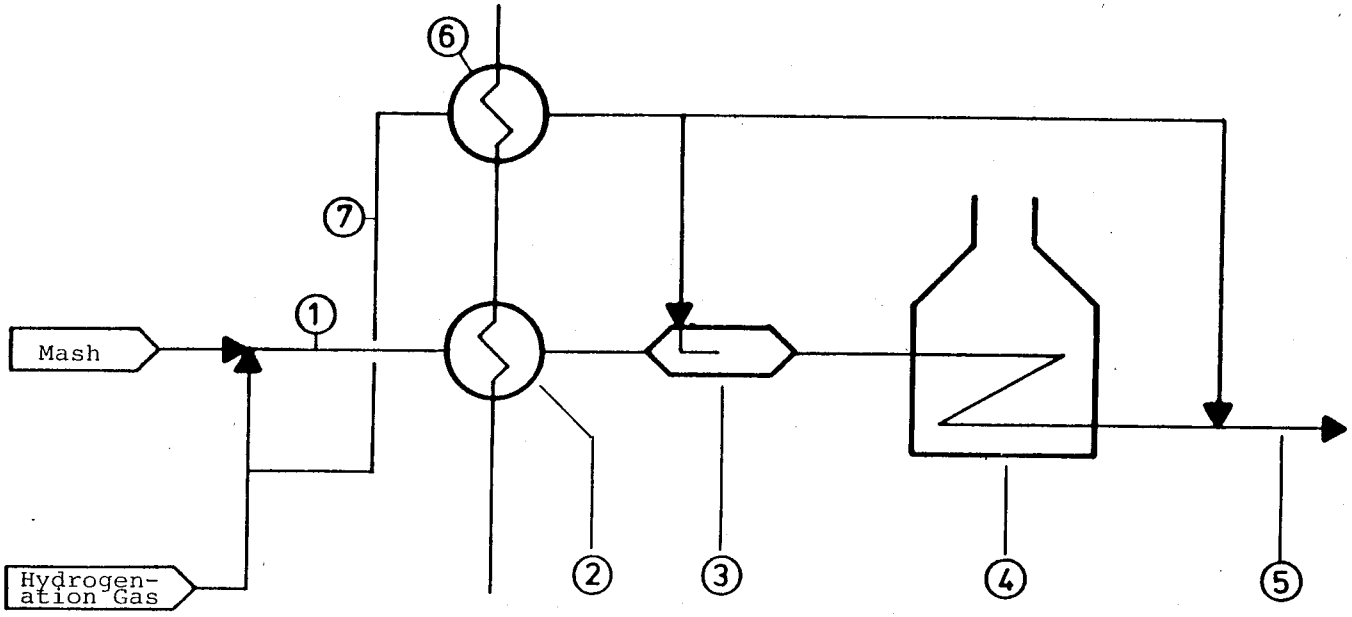

According to FIG. 3, the flow of hydrogenation gas heated in gas heat exchanger 6 is added to the slurry in one part in swelling section 3 and in the other part downstream from the preheater 4.

Within the framework of the embodiment of this method shown in FIG. 1, it is also advantageous to replace for the purpose of heating up the hydrogen gas altogether the gas heat exchanger 6 by the furnace 8. In this case, the hydrogenation gas carried in conduit 7 can be heated to, e.g., 550° C.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for pretreating a coal hydrogenation feedstock with preheated hydrogen containing hydrogenation gas under high pressure and at elevated temperature, in a liquid phase slurry system, in which a mixture of a slurry of finely ground coal and a slurry oil are fed to a preheater before being subjected to a hydrogenation and liquefaction reaction in a cascade of reactors at a pressure of from 100 to 400 bar and a temperature of 420° to 490° C., and wherein the reaction products are fed to a hot separator;

in which, prior to its preheating a first partial stream, referred to as slurry gas, of the hydrogenation gas is added to the said mixture at process pressure, said method comprising:

(i) heating a second partial stream of the hydrogenation gas by indirect heat exchange with the gaseous hot separator head product in a gas heat exchanger;

(ii) preheating the mixture of slurry and slurry gas through indirect heat exchange in at least one heat exchanger downstream from the said first gas heat exchanger, through which flows the hot separator head product after passing through the said first heat exchanger; and (iii) adding the thus heated second partial stream of hydrogenation gas to the preheated mixture of slurry and slurry gas.

2. The method of claim 1, comprising adding a catalyst to the said liquid phase system.

3. The method of claim 1, comprising using 50 to 80% by volume of the total required quantity of hydrogenation gas as the said second partial stream of the hydrogenation gas.

4. The method of claim 1, comprising adding the said second partial stream of the hydrogenation gas passed through the gas heat exchanger to the mixture of slurry and slurry gas only after the mixture has passed through the preheater.

5. The method of claim 1, comprising using, in addition to the gas heat exchanger, a furnace for heating the said second partial stream of the hydrogenation gas.

6. The method of claim 1, comprising using a furnace for heating the said second partial stream of the hydrogenation gas in place of the said gas heat exchanger, and wherein the hot separator product is used for preheating the mixture of slurry and slurry gas.

7. The method of claim 1, comprising distributing the flow of the hydrogen-containing hydrogenation gas in such a manner that slurry gas added to the mixture is fresh hydrogen, and the remaining quantity of fresh hydrogen to be added is added to the said second partial stream of the hydrogenation gas.

8. The method of claim 1, comprising providing a swelling section upstream of step (ii).

9. The method of claim 1, comprising adding the said heated second partial stream of the hydrogenation gas to the mixture of slurry and slurry gas upstream of the preheater.

10. The method of claim 1, comprising adding the said second partial stream of the hydrogenation gas to the mixture of slurry and slurry gas downstream from the preheater.

* * * * *

UNITED STATES PATENT AND TRADEMARK OFFICE

CERTIFICATE OF CORRECTION

PATENT NO. : 4,666,589

DATED : May 19, 1987

INVENTOR(S) : WOLF-DIETER KLEIN ET AL

It is certified that error appears in the above-identified patent and that said Letters Patent is hereby corrected as shown below:

In the Abstract, line 8, change "40" to read --400--.

Column 1, line 45, change "coaloil" to read --coal oil--.

Column 4, line 22, change "admixxed" to read --admixed--; line 52, change "expansion" to read --swelling--.

Signed and Sealed this

Seventeenth Day of May, 1988

*Attest:*

DONALD J. QUIGG

*Attesting Officer*

*Commissioner of Patents and Trademarks*